United States Patent [19]

Reist

[11] Patent Number: 4,498,664

[45] Date of Patent: Feb. 12, 1985

[54] APPARATUS FOR REMOVING FROM A PRODUCT STREAM CONVEYED BY MEANS OF A CONVEYOR DEVICE FLEXIBLE, FLAT PRODUCTS, ESPECIALLY PRINTED PRODUCTS

[75] Inventor: Walter Reist, Hinwil, Switzerland

[73] Assignee: Ferag AG, Hinwil, Switzerland

[21] Appl. No.: 360,212

[22] Filed: Mar. 22, 1982

[30] Foreign Application Priority Data

Apr. 9, 1981 [CH] Switzerland ..... 2388/81

[51] Int. Cl.[3] ..... B65H 29/04

[52] U.S. Cl. ..... 271/204; 271/188; 271/199; 271/300

[58] Field of Search ..... 271/204, 188, 217, 199, 271/205, 206, 300

[56] References Cited

U.S. PATENT DOCUMENTS

| | | | |
|---|---|---|---|
| 1,210,465 | 1/1917 | Gubelman | 271/188 |
| 2,673,735 | 3/1954 | Niles et al. | 271/300 |
| 3,160,413 | 12/1964 | Faeber | 271/209 |
| 3,391,928 | 7/1968 | Mowry et al. | 271/204 |
| 4,039,182 | 8/1977 | Reist | 271/204 |

*Primary Examiner*—Duane A. Reger
*Assistant Examiner*—John A. Carroll
*Attorney, Agent, or Firm*—Werner W. Kleeman

[57] ABSTRACT

For removing printed products out of their composite product formation or arrangement the grippers of a conveyor device which grippingly retain such printed products are opened by means of a release device. Viewed in the product conveying direction, the printed products are bent in a substantially saddle-shaped fashion forwardly of the release device, so that these folded or bent printed products are stiffened and, following the release thereof, they can drop downwardly along a substantially straight fall path into a stacking chute. For appropriately kinking or bending the printed products there is provided a saddle-shaped support member at which come to bear the printed products at the region of their trailing edges, such printed products being grippingly retained at their leading edges by the grippers approximately at the central region thereof. The printed products can be detached or released out of their product formation along an extremely short path even when working with high conveying speeds of the conveyor device.

23 Claims, 5 Drawing Figures

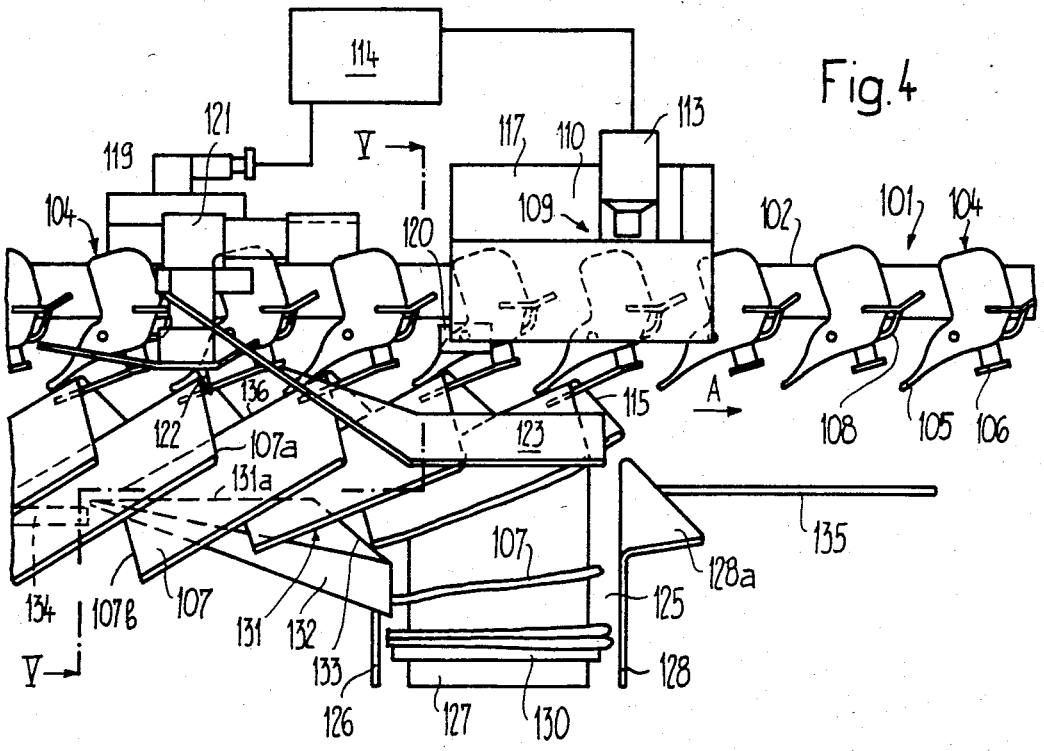
Fig. 4
Fig. 5
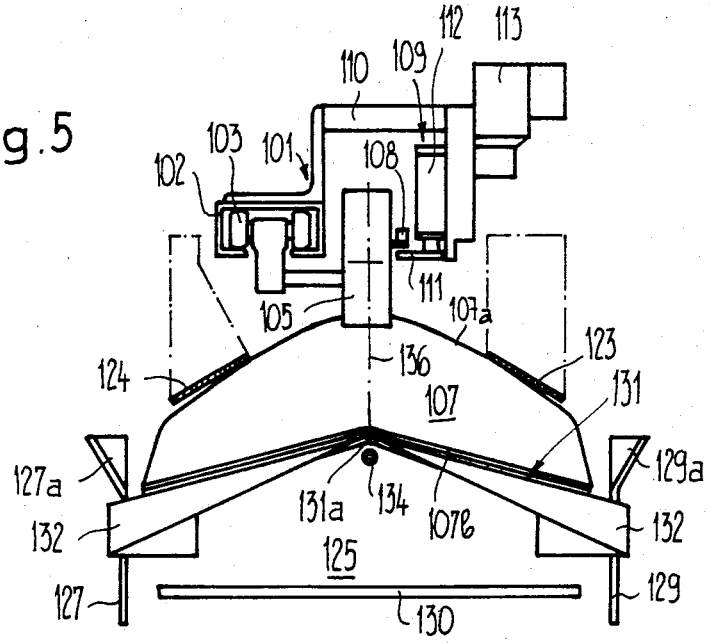

APPARATUS FOR REMOVING FROM A PRODUCT STREAM CONVEYED BY MEANS OF A CONVEYOR DEVICE FLEXIBLE, FLAT PRODUCTS, ESPECIALLY PRINTED PRODUCTS

CROSS REFERENCE TO RELATED APPLICATIONS

This application is related to my commonly assigned, U.S. Pat. No. 4,445,681, issued May 1, 1984, entitled "Apparatus For Removing From a Product Stream Conveyed by Means of a Conveyor Device Flexible Flat Products, Especially Printed Products", and also to my commonly assigned copending U.S. application Ser. No. 377,325, filed May 12, 1982 entitled "Apparatus For Stacking Flat Products, Especially Printed Products, Arriving in an Imbricated Product Stream".

BACKGROUND OF THE INVENTION

The present invention relates to a new and improved construction of apparatus for releasing or removing flexible, flat products, especially printed products, out of a product stream or formation conveyed by means of a conveyor device, the printed products being retained by gripper elements of the conveyor device, these gripper elements or grippers being attached in spaced relationship from one another at a traction element or the like.

Generally speaking, the apparatus for the removal of flexible, flat products, especially printed products out of their product stream, wherein the products preferably overlap or overlie one another in an imbricated fashion, contains at least one release device which can be selectively switched-on and switched-off, wherein in the switched-on mode of the release device there are opened the grippers moving past the release device.

In British Pat. No. 921,094 there is disclosed an apparatus of this general type, wherein the products, in the form of printed individual sheets, are stacked following their release by the grippers. Now in order to ensure for a faultless deposition of the released products, even at relatively high conveying speeds, the released products must be braked at their trailing edges, shortly prior to their release by the grippers, by means of a brake device which operates at a negative pressure. The provision of a satisfactorily operating brake device requires a corresponding constructional expenditure in the equipment. Additionally, this prior art solution is afflicted with the drawback that when handling multi-sheet printed products, such as newspapers and periodicals, only part of the sheets are held back by the brake device, whereas the remaining sheets move further without being acted upon by the brake device. Therefore, the danger exists that such type of multi-sheet printed products will be damaged.

Similar drawbacks prevail for the equipment disclosed in U.S. Pat. No. 1,465,385 which is complicated in construction, and wherein each of the products, again individual or single sheets, released by the grippers are retained in suspension by an air cushion during the product alignment operation. Because of the thus resulting delay during the deposition of each product it is not possible to randomly accelerate the product stacking operation. This means that the operating speed of such equipment is limited.

SUMMARY OF THE INVENTION

Therefore, with the foregoing in mind it is a primary object of the present invention to provide a new and improved construction of apparatus for releasing flexible, flat products, especially printed products, out of their product stream or formation and which products are conveyed by means of a conveyor device, in a manner not afflicted with the aforementioned drawbacks and limitations of the prior art constructions.

Another and more specific object of the present invention aims at the provision of an apparatus of the previously mentioned type which is capable of being fabricated in a relatively simple and economical fashion, and by means of which it is possible to faultlessly release out of the product stream, within an extremely short path, both thin and thick products, especially also multi-sheet printed products.

Still a further significant object of the present invention is directed to a new and improved construction of apparatus for the effective removal or release from a product stream flexible, flat products which are conveyed by means of a conveyor device, which apparatus is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the inventive apparatus for the release of the products is manifested by the features that there are provided means for bending the products at a region of the product conveying path which is located forwardly or upstream of the release device.

Due to the kinking or bending operation the products inbounding the release device have imparted thereto a stiffening action. As a result, the products, after they have been successfully released by the grippers, immediately move downwardly under the action of the force of gravity and essentially along a linear fall or drop path. Hence, with relatively modest constructional expenditure and equipment design there is rendered possible a faultless and positive release or detachment of the products out of the conveyed product stream practically at the site of the release device, i.e. along an extremely short release path. Moreover, for this purpose there is not required the use of any additional force for moving the products downwardly. Also, there are not needed any means for braking the products.

This release of the products is particularly then ensured if such products, prior to their release, are bent into a substantially saddle-shaped structure having a ridge line extending in the product conveying or feed direction. In order to obtain such saddle-like or saddle-roof like configuration of the printed products, there is provided a saddle-shaped or rod-shaped configured support member which, viewed in the direction of conveying or feed of the products, preferably terminates at a spacing forwardly or upstream of the release device and is disposed below the conveyor device. The products which are retained at their leading edges at the grippers at least come to bear at the region of their trailing edges at the support member.

BRIEF DESCRIPTION OF THE DRAWINGS

The invention will be better understood and objects other than those set forth above, will become apparent when consideration is given to the following detailed description thereof. Such description makes references to the annexed drawings wherein:

FIGS. 4 and 5 illustrate, like the showing of FIGS. 2 and 3, a further exemplary embodiment of inventive apparatus without any stops or impact members.

DETAILED DESCRIPTION OF THE PREFERRED EMBODIMENTS

Figure 1:
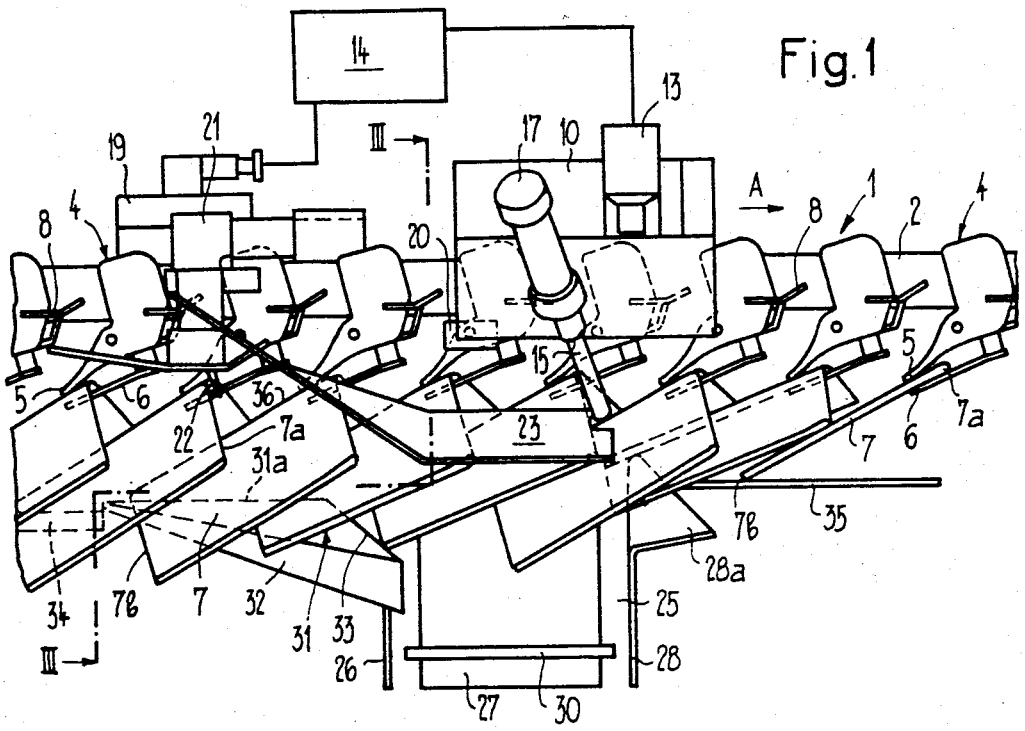
FIG. 1 is a side view of an apparatus for releasing or removing printed products conveyed in an imbricated or lapped product formation out of the product or conveyed stream and depicting the release device switched-off or disabled and the stop or impact members in their retracted position out of the product stream.

Describing now the drawings, it is to be understood that only enough of the construction of the product removal apparatus has been shown therein so as to simplify the illustration while still enabling those skilled in the art to readily understand the underlying principles and concepts of the present development. Turning attention now to the exemplary embodiment depicted in FIGS. 1 to 3, reference numeral 1 designates a conveyor device which, both as to its construction and mode of operation, essentially corresponds to the conveyor device described in detail in German Patent Publication No. 2,519,561 and the corresponding U.S. Pat. No. 3,955,667. It is for this reason that in the description to follow the construction and operation of such conveyor device or conveyor means 1 only will be briefly referred to as needed for fully understanding the present invention. This conveyor device 1 possesses a chain 3 or equivalent traction structure which is guided in a guide channel 2. Attached in spaced relationship from one another at the traction chain 3 are grippers or gripper elements 4. The construction of the chain 3 may be like that described in detail in Swiss Pat. No. 588,647 and the corresponding British Pat. No. 1,549,283. Each gripper or gripper element 4 possesses a fixed or stationary clamping jaw or tongue 5 and a movable clamping jaw or tongue 6 coacting with the stationary clamping jaw or tongue 5. When the grippers 4 are closed both of the clamping tongues or clamping jaws 5 and 6 fixedly retain the printed products 7 at the region of their leading edges *7a*, the so-called folding edge or spine. The movable clamping jaws or tongues 6 are retained in their closed position by means of a respective related blocking or locking element 8.

Figure 2:
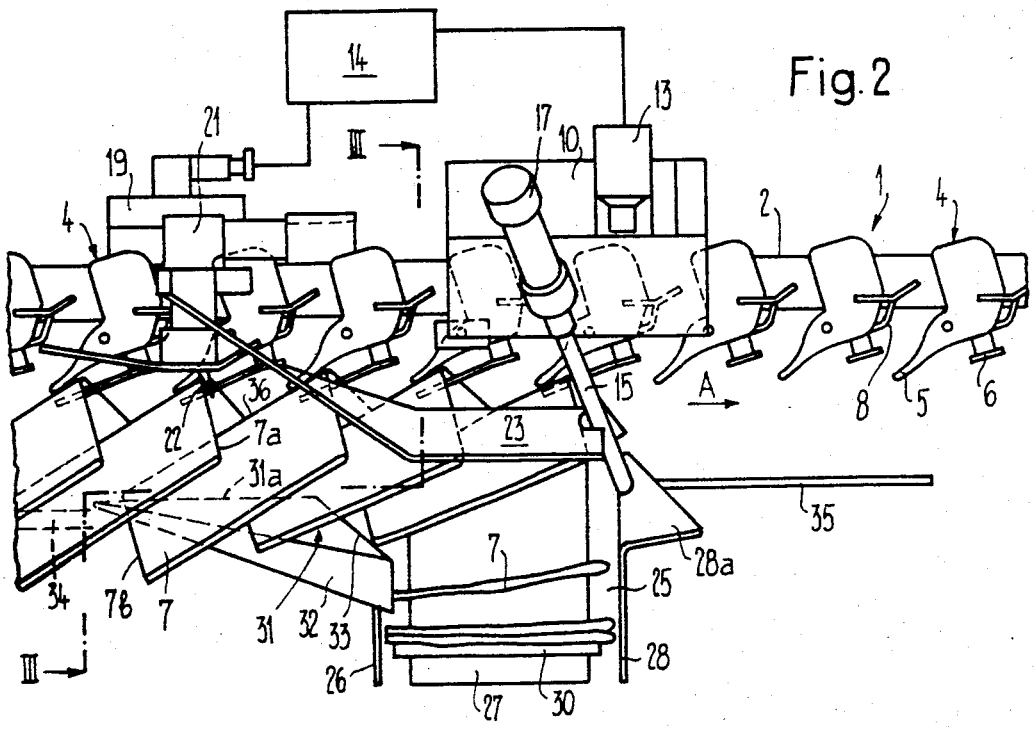
FIG. 2 illustrates the apparatus depicted in FIG. 1 with the release device switched-on or enabled and the stop or impact members in their introduced or extended position at the product conveying path or product stream.
Figure 3:
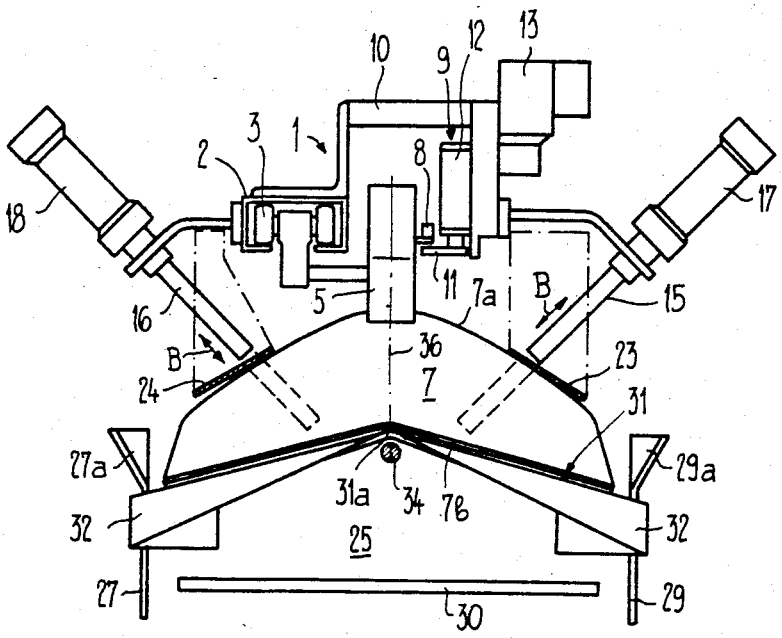
FIG. 3 is a cross-sectional view through the apparatus shown in FIGS. 1 and 2, taken substantially along the line III—III thereof.

As best seen by referring to FIG. 3, the opening of the grippers or gripper elements 4 is accomplished by means of a release device 9 which is mounted at a holder element or support 10 attached to the channel 2. This release device 9 possesses a control element or actuator 11 which can be raised and lowered by the action of a suitable drive, here shown as a pneumatic piston-and-cylinder unit 12. This piston-and-cylinder unit 12 is actuated by means of an electro-pneumatic control valve 13 which is operatively connected with a not particularly illustrated but suitable pressurised air connection. This control valve 13 is operatively connected with a suitable control means or control 14. In its lower terminal position, depicted in FIG. 3, the control element or actuator 11 has no effect upon the blocking or locking elements 8, so that the grippers 4 moving therepast are not opened, as best seen by referring to FIG. 1. On the other hand, if the control element 11 is located in its upper terminal or end position, then it positively acts upon the blocking or locking elements 8 or the grippers 4, so that the movable clamping jaws or tongues 6 are unlocked and are rocked or pivoted into their open position. The printed products 7 are thus effectively released, as such has been depicted particularly well in FIG. 2.

Two substantially rod-shaped stop or impact members 15 and 16 are arranged at the region of the release device or release means 9. These stop or impact members 15 and 16 are situated opposite one another with respect to the grippers or gripper elements 4, as best recognised by referring to FIG. 3. Each stop or impact member 15 and 16 is drivingly connected with a suitable drive, here for instance also a related pneumatic piston-and-cylinder unit 17 and 18, respectively. By means of the appertaining piston-and-cylinder unit 17 and 18 the impact or stop rods or rod-like impact members 15 and 16 are selectively displaced in the direction of their lengthwise axis, i.e. in the direction of the double-headed arrow B. The piston-and-cylinder units 17 and 18 are connected by means of a not particularly illustrated connection line with an electro-pneumatic control valve 19 which likewise is connected with the control means 14 and is attached at the channel 2. Additionally, this control valve 19 is connected with a not particularly shown but conventional source of compressed or pressurised air. In FIGS. 1 and 3 the stop or impact members 15 and 16 have been shown in their retracted or ineffectual position where they are located externally of the conveying or feed path of the printed products 7, i.e. the stop members are retracted towards their related piston-and-cylinder units 17 and 18, respectively. On the other hand, in FIG. 2 the stop or impact members 15 and 16 are shown in their introduced or extended position i.e. their effectual position where they protrude into the aforementioned product conveying path. This extended position has been illustrated in FIG. 3 in broken lines.

At the underside of the channel 2 there is arranged a proximity switch 20 (FIG. 1) of known construction which, upon movement therepast of each gripper or gripper element 4, generates a clock pulse which is inputted to the control means 14. By means of the pulses produced by the proximity switch 20 or equivalent structure there is determined the control cycle or clock.

Additionally, a suitable counter 21 is mounted at the channel or channel means 2, this counter 21 likewise being of conventional design. Counter 21 possesses a detector finger 22 which protrudes into the conveying path of the printed products 7. This finger 22 is actuated by the leading edges *7a* of the printed products 7 moving therepast and, whenever such finger 22 is actuated, there is generated a counting pulse which likewise is inputted to the control means 14.

Viewed in the conveying direction A of the conveyor device 1 there is arranged forwardly or upstream of each stop or impact member 15 and 16 a guide element 23 and 24, respectively, which covers or underlies the related stop member 15 and 16 in its retracted position and ensures that none of the printed products 17 will impact against the stop members 15 and 16 when located in their retracted or ineffectual position.

Beneath the stop members 15 and 16 there is arranged a product stacking or stacker chute 25 which is defined by the chute walls 26, 27, 28 and 29. To avoid any damage to the printed products 7 the chute walls 27, 28 and 29 are flexed at the region of their upper corners 27*a*, 28*a* and 29*a*, respectively. The stacking or stacker chute 25 is closed at its lower end or bottom region by an elevationally displaceable, i.e. up-and-down movable support table 30 or equivalent structure. Arranged forwardly of such stacking chute 25, viewed with respect to the product conveying direction A, is a substantially ridged or saddle-shaped support member 31 for the printed product 7. The ridge line 31*a* of such support member 31 extends essentially parallel to the product conveying direction A. The support member 31 is provided with side portions 32 which extend essentially in vertical direction. Additionally, it will be seen that the support member or element 31 terminates at a spacing from the stop members 15 and 16 which are located in their introduced or inserted position along the product conveying path and possesses at such end confronting the stop or impact members 15 and 16 edges 33 which extend obliquely or at a slant downwardly. The saddle-shaped or saddle roof-like support member 31 has arranged forwardly or upstream thereof a substantially rod-shaped support element 34 which essentially is in alignment with the ridge line 31*a* of the support member 31.

Also viewed in the product conveying direction A there merges at the stacking chute 25 a support element 35 for the printed products 7 which move past the stacker chute 25. This support element 35 can be of random design and, for instance, can consist of two mutually parallel rods. However, it is also possible to use only a single rod or rod member.

Having now had the benefit of the foregoing description of the exemplary embodiment of product release or removal apparatus its mode of operation will be described and is as follows:

As shown in the drawings, the printed products 7 are retained at their leading edges 7*a* by the grippers or gripper elements 4 approximately at their central region. As soon as the printed products 7 come to bear at the region of their trailing edges 7*b* upon the rod-shaped support member 34 they are kinked or bent about a kinking or bend line 36 which extends essentially in the product conveying direction A. The printed products 7 thus have imparted thereto a substantially saddle-shaped configuration, as clearly recognized by referring to the drawings. Thereafter, the printed products 7 come to bear upon the saddle-shaped support member 31, so that there is imparted a defined saddle or roof-shaped configuration to the printed products 7. Due to this kinking or bending action about the kink or bend line 36 there is caused a stiffening of the printed products 7. This stiffening is of extreme significance for the hereinafter still to be described product release operation.

In FIGS. 1 and 3 there has been illustrated the release device 9 in its switched-off or ineffectual state. This means that the control element 11 is located in its lower, ineffectual or inactive position where it, as explained, does not have any effect upon the blocking or locking elements 8 of the grippers 4. At the same time the stop or impact members 15 and 16 are completely retracted, so that they are located externally of the product conveying path of the printed products 7. The grippers 4 travel, without being opened, past the release device 9 and transport the printed products 7 below the stop or impact members 15 and 16 and over the stacking chute 25 or equivalent structure, as the same has been shown in FIG. 1.

Now if printed products 7 should be removed out of the imbricated product formation or stream and stacked in the stacking or stacker chute 25, then the release device 9 must be switched-on and the stop or impact members 15 and 16 extended or inserted into the product conveying path. By means of a command "release" the control or control means 14, based upon the clock pulses produced by the proximity switch 20, produces synchronised control commands for the control valves 13 and 19, and there is taken into account that the release device 9, viewed in the product conveying direction A, is arranged at a certain spacing behind the stop or impact members 15 and 16. By the action of the control commands produced by the control means 14 the control valves 13 and 19 are switched. As a result, the control element 11 of the release device 9 is brought into the upper terminal or end position and the stop members 15 and 16 are moved downwardly in the direction of the arrow B into their effective position, where they protrude into the product conveying path, as the same has been clearly shown in FIG. 2. By the action of the control means 14 there is ensured that the switching-on of the release device 9 and the insertion or thrusting of the stop members 15 and 16 into the product conveying path or stream is accomplished synchronously with respect to one another.

By means of the release device 9 the grippers or gripper elements 4 moving therepast are opened in the already described manner. Consequently, the printed products 7 are released, which now contact at their leading edges 7*a* the stop or impact members 15 and 16. At the moment of impact or contact the printed products 7 no longer bear upon the support member 31, however still possess their saddle-shaped configuration. As best seen by referring to FIG. 2, a rebound of the printed products 7 which impact against the stop or impact members 15 and 16 is prevented in that, the printed products impact by means of their trailing edges 7*b* at the obliquely extending edges 33 of the support member 31. The released printed products 7, due to their inherent weight, fall downwardly into the stacking chute 25 and come to bear at the support table 30 or, as the case may be, upon the printed products already bearing upon such support table 30. The saddle-shaped configuration of the printed products 7 causes a stabilization of the movement of the printed products 7 during their free fall into the stacker chute 25. This has a particularly advantageous effect upon thin products which have the tendency, during their free fall, of performing a wobbling movement. Due to this stabilization of the floating or suspended motion of the printed products 7 there is achieved the beneficial result that these printed products tend to fall downwardly essentially along a linear or straight path. Consequently, there is obtained the advantage that the printed products 7 will be stacked in an aligned fashion. Therefore, there can be reduced to a minimum or, in fact, eliminated the need for special facilities for the alignment of the product stack.

The roof-shaped configuration of the printed products 7 affords still further advantages. Viewed in a top plan projection, the printed products 7 when in their saddle-shape occupy a lesser area than the area occupied when the printed products are spread out in the plane of a top plan view of such printed products. Consequently, the products released by the grippers 4 can be introduced without difficulty between the stacker chute walls 26, 27, 28 and 29. During the course of the falling or dropping motion both halves of the printed products 7 which are bent along the line 36 and originally form an angle with one another are again upwardly pivoted into a common plane. As a result, the printed products 7 arrive with their side edges in contact with the chute walls 26, 27, 28 and 29, so that there is realised an advantageous guiding and alignment of the printed products 7. Independent of the thickness of the printed products 7 there is thus accomplished a faultless formation of the product stack.

As already explained, the counter 21, whenever each printed product 7 moves therepast, generates a counting pulse which is inputted to a counting device of the control means 14. The desired or set point number of printed products per stack is inputted into the aforementioned counting device. The counting pulses cause a rearwards or down counting of this counting device. If the counting device has reached the counter state null, then control commands are generated by the control or control means 14, by means of which the control valves 13 and 19 are switched—these valves also sometimes being referred to in the art as displacement control valves. The release device 9 is switched, and the stop or impact members 15 and 16 are again moved upwardly out of the product conveying stream. The grippers 4 together with the printed products 7 retained thereat thus move past the stacker chute 25, which now can be emptied in conventional fashion.

The stiffening of the products which is produced by the bending of the printed products 7 about a bending or fold line 36, extending essentially in the product conveying direction A, prior to impingement of the printed products against the stop or impact members 15 and 16 and the resultant saddle-shaped product configuration obtained in this manner, afford the beneficial results that after release of the printed products 7 they tend to fall under the action of their inherent weight along an essentially linear path downwardly into the stacker chute 25. The printed products 7 therefore can be released and outfed from the product formation at the location where they are freed by the grippers or gripper elements 4.

The previously described product removal or release apparatus can be, of course, also modified in a number of aspects and the parts and components thereof differently configured and structured than has been illustrated by way of example and not limitation. In the description to follow there will be explained several of such possible modifications which can be readily made.

A simple and reliable kinking or bending of the printed products is possible in the manner described previously in conjunction with the drawings. However, it is also conceivable to kink or bend the printed products with the use of other means or in a different manner. The support rod or rod member 34, arranged forwardly or upstream of the saddle-like configured support member 31, and which support rod causes a pre-bending or pre-kinking of the printed products, also can be dispensed with under circumstances. Moreover, with certain fields of application the saddle-like or saddle roof-like configured support member 31 can be replaced by a support rod which corresponds to the support element 34.

The release device 9 and the stop or impact members 15 and 16 can be actuated in a different manner, for instance instead of pneumatically also hydraulically or even otherwise. Also, other conveyor devices of suitable construction can be employed, such as for instance a conveyor device as the same has been described in German Patent Publication No. 3,102,242 and the corresponding British Patent Publication No. 2,068,892. Also each gripper or gripper element 4 or equivalent structure can retain two or more printed products 7.

Also, there can be provided a plurality of transfer or delivery locations for the printed products 7 and which are arranged in succession or tandem in the product conveying direction A, as such has been disclosed for instance in German Patent Publication No. 2,752,513 and the corresponding British Pat. No. 1,568,752. At each of such transfer locations there would be provided a release device 9 and the stop or impact members 15 and 16. Since, as already explained, the printed products 7 can be released out of the product conveying path or stream along an extremely short path, such transfer locations can be oriented in close proximity behind one another.

It should be understood that the printed products 7 which have been released out of the imbricated product formation or array need not absolutely be stacked. Thus, it would be, for instance, conceivable to deposit the released printed products 7, instead of upon the support table 30, upon a conveyor belt or band which is located below the stacker chute 25 formed by the chute walls 26, 27, 28 and 29.

A faultless detachment or release of the printed products out of their imbricated or lapped product formation, as has been described previously based upon FIGS. 1 to 3, also is possible without the provision of the stop or impact members 14 and 15. An appropriate apparatus suitable for this purpose has been shown in FIGS. 4 and 5 as a further possible modification of the invention.

FIG. 4 corresponds in its illustration to that of FIG. 2, whereas FIG. 5, which constitutes a sectional view taken substantially along the line V—V of FIG. 4, is comparable in its manner of illustration to the showing of FIG. 3. Furthermore, as a matter of convenience in both FIGS. 4 and 5 there have been used essentially the same reference numerals to denote the same or analagous components as were used in the arrangement of FIGS. 1 to 3 described above, however in FIGS. 4 and 5 each of such reference numerals has been raised by the number 100. Thus, for instance, the conveyor device designated in FIGS. 4 and 5 by reference character 101 corresponds to the conveyor device 1 according to the embodiment of FIGS. 1 to 3.

Since, as already explained, the variant apparatus according to FIGS. 4 and 5 only differs by virtue of the absence of the stop or impact members 15 and 16 as well as the related piston-and-cylinder units 17 and 18, respectively, from the construction of apparatus shown in FIGS. 1 to 3 and also basically corresponds to the function of the latter, therefore as to the construction and mode of operation of the equipment depicted in FIGS. 4 and 5 reference is therefore made to the corresponding explanations previously given in conjunction with the embodiment of FIGS. 1 to 3 in this regard.

As already previously explained based upon the showing of the embodiment of FIGS. 1 to 3, also with the embodiment of FIGS. 4 and 5 the stiffening or reinforcement action which is brought about by bending or kinking the printed products 107 about a fold line 136 extending essentially in the product conveying direction A and the saddle-shaped product configuration obtained in this manner results in the printed products 107, after their release by the grippers 104, essentially falling linearly downwardly into the stacker chute 125. Consequently, the printed products 107 be be released out of their product formation of stream and transported away at the site of their release by the grippers 104, i.e., at the region of the release device 109.

The guide elements 123 and 124, which because of the omission of the stop or impact members 15 and 16 no longer serve for convering the same, here assume the function of an upper guide for the printed products 107. These guides elements 123 and 124, which extend over the stacker chute 125 and likewise may possess a substantially saddle-shaped configuration, come to bear to both sides of the bending or kink line 136 of the saddle-shaped folded printed products 107 upon their upper surface. Hence, these guide elements 123 and 124 prevent the lateral edges of the printed products 107, after their release by the grippers 104, from being able to move upwardly.

Since, as already explained, with both exemplary embodiments the printed products have imparted thereto a stiffening or reinforcement action by the bending or folding process, it is possible to not only process thick, multi-sheet products with the desired exemplary embodiments of the apparatus, but also thin products and individual or single sheets, because by virtue of such stiffening effect these thin products are less prone to becoming damaged. It is here further mentioned that with the described equipment it is possible to detach from the product conveying stream or formation also flexible, flat products other than printed products.

While there are shown and described present preferred embodiments of the invention, it is to be distinctly understood that the invention is not limited thereto, but may be otherwise variously embodied and practiced within the scope of the following claims.

Accordingly, What I claim is:

1. An apparatus for removing flexible, substantially flat products, especially printed products, from a product conveying stream moving in a predetermined product conveying direction and defining a product conveying path comprising:

a conveyor device;

said conveyor device being provided with gripper elements arranged in spaced relationship from one another at said conveyor device;

said gripper elements releasably retaining said flexible products;

at least one release device which can be selectively switched-on and switched-off;

said release device, when assuming its switched-on condition, opening the individual gripper elements moving therepast for releasing said products; and means for bending said products into a substantially saddle-shaped configuration about a line extending essentially in the product conveying direction and which bending means are arranged, viewed in the product conveying direction, in the region of the product conveying path upstream of said release device, the products being kept in said substantially saddle-shaped configuration until the gripper elements are opened by said release device.

2. The apparatus as defined in claim 1, wherein:

said means for bending said products comprises a support member arranged below said conveyor device; and said products which are retained at their leading product edges by said gripper elements coming to bear at least at the region of their trailing edges upon said support member.

3. The apparatus as defined in claim 2, wherein:

said support member terminates at a spacing from said release device.

4. The apparatus as defined in claim 3, wherein:

said support member has a substantially saddle-shaped configuration.

5. The apparatus as defined in claim 3, wherein:

said support member possesses a substantially rod-shaped configuration.

6. The apparatus as defined in claim 2, wherein:

said support member has a substantially saddle-shaped configuration.

7. The apparatus as defined in claim 2, wherein:

said support member possesses a substantially rod-shaped configuration.

8. The apparatus as defined in claim 4, wherein:

said support member possesses at an end thereof confronting the release device a sloped portion extending away from the conveyor device in the product conveying direction.

9. The apparatus as defined in claim 4, further including:

a substantially rod-shaped support element arranged forwardly of the saddle-shaped support member viewed in the product conveying direction; and said rod-shaped support element being substantially aligned with a ridge line of said support member.

10. The apparatus as defined in claim 6, wherein:

said support member possesses at an end thereof confronting the release device a sloped portion extending away from the conveyor device in the product conveying direction.

11. The apparatus as defined in claim 6, further including:

a substantially rod-shaped support element arranged forwardly of the saddle-shaped support member viewed in the product conveying direction; and said rod-shaped support element being substantially aligned with a ridge line of said support member.

12. The apparatus as defined in claim 1, further including:

a guide element for the products arranged forwardly of said release device in the product conveying direction; and said guide element being intended to act upon an upper surface of the products.

13. The apparatus as defined in claim 12, wherein:

said means for bending said products comprises a support member arranged below said conveyor device;

said products which are retained at their leading product edges by said gripper elements coming to bear at least at the region of their trailing edges upon said support member; and said guide element following the support member viewed in the product conveying direction of the conveyor device and being structured to possess an essentially saddle-shaped configuration.

14. The apparatus as defined in claim 13, wherein:

said guide element possesses two members extending in the product conveying direction of the conveyor device and arranged to respective sides of a predetermined path of movement of the gripper elements.

15. The apparatus as defined in claim 1, further including:

chute means for the reception of the released products arranged below the conveyor device at the region of the release device.

16. The apparatus as defined in claim 15, wherein:

said means for bending said products comprises a support member arranged below said conveyor device;

said products which are retained at their leading product edges by said gripper elements coming to bear at least at the region of their trailing edges upon said support member; and said chute means, viewed with respect to the product conveying direction of the conveyor device, essentially following said support member.

17. The apparatus as defined in claim 15, further including:

a guide element for the products arranged forwardly of said release device in the product conveying direction;

said guide element being intended to act upon an upper surface of the products; and said guide element extending over said chute means.

18. The apparatus as defined in claim 15, wherein:

said chute means is structured as a stacking chute.

19. The apparatus as defined in claim 18, wherein:

said stacking chute has a bottom region; and a support table for closing said bottom region of said stacking chute.

20. The apparatus as defined in claim 19, wherein:

said support table comprises an elevationally displaceable support table structure.

21. The apparatus as defined in claim 1, wherein:

said gripper elements fixedly retain the products essentially at a central region of their leading edges.

22. The apparatus as defined in claim 15, wherein:

said means for bending the products at the region of the product conveying path is arranged forwardly of said chute means.

23. An apparatus for stacking flexible, substantially flat products, especially printed products, conveyed in a conveying stream in a predetermined product conveying direction along a predetermined product conveying path, comprising:

a conveyor device;

said conveyor device being provided with gripper elements arranged in spaced relationship from one another at said conveyor device;

said gripper elements releasably retaining said flexible products at a leading edge thereof viewed in said product conveying direction;

at least one release device which can be selectively switched-on and switched-off;

said release device, when assuming its switched-on condition, opening the individual gripper elements moving therepast for releasing said products;

at least one stacking chute means for stacking said products which are released from said individual gripper elements;

said at least one stacking chute means defining a forward end and a rearward end in respect of said product conveying direction and said at least one release device being arranged in the region of said forward end of said at least one stacking chute means;

bending means comprising rod means substantially extending in said product conveying direction and bending said products into a substantially saddle-shaped configuration about a line substantially extending in said product conveying direction;

said bending means being arranged in the region of said product conveying path and preceding said rearward end of said at least one stacking chute means; and said bending means acting at least on a trailing edge of said products in order to form said substantially saddle-shaped, bent configuration thereof while the products are conveyed by the individual gripper elements in said product conveying direction towards said at least one stacking chute means and the products are maintained in such substantially saddle-shaped, bent configuration while said individual gripper elements move across said at least one stacking chute means towards said at least one release device.

* * * * *

UNITED STATES PATENT AND TRADEMARK OFFICE

CERTIFICATE OF CORRECTION

PATENT NO. : 4,498,664

DATED : February 12, 1985

INVENTOR(S) : WALTER REIST

It is certified that error appears in the above-identified patent and that said Letters Patent is hereby corrected as shown below:

Column 9, line 13, please delete "be" (first occurrence) and insert --can--

Column 9, line 19, please delete "convering" and insert --covering--

Column 9, line 21, please delete "guides" and insert --guide--

Signed and Sealed this

*Twenty-third* Day of *July 1985*

[SEAL]

*Attest:*

DONALD J. QUIGG

*Attesting Officer*

*Acting Commissioner of Patents and Trademarks*